United States Patent [19]

Drzewiecki et al.

[11] 4,190,083

[45] Feb. 26, 1980

[54] FLUIDIC LOGICAL PYROTECHNIC INITIATOR

[75] Inventors: Tadeusz M. Drzewiecki, Silver Spring, Md.; John M. Goto, Falls Church, Va.

[73] Assignee: The United States of America as represented by the Secretary of the Army, Washington, D.C.

[21] Appl. No.: 831,320

[22] Filed: Sep. 7, 1977

[51] Int. Cl.[2] ..... F15C 1/08

[52] U.S. Cl. ..... 137/838; 137/840; 137/841

[58] Field of Search ..... 137/838, 840, 841; 102/224

[56] References Cited

U.S. PATENT DOCUMENTS

| | | | |
|---|---|---|---|
| 3,283,768 | 11/1966 | Manion | 137/840 X |
| 3,420,255 | 1/1966 | Wilkerson | 137/840 X |
| 3,481,354 | 12/1969 | Chen | 137/838 X |
| 3,507,294 | 4/1970 | Fix | 137/841 X |
| 3,508,563 | 4/1970 | Riply | 137/841 |
| 3,570,512 | 3/1971 | Thompson | 137/840 |
| 3,578,010 | 5/1971 | Campagnuolo | 137/840 X |
| 3,578,011 | 5/1971 | Holmes | 137/834 X |
| 3,671,134 | 6/1972 | Boothe | 137/819 X |
| 3,731,700 | 5/1973 | Cohen | 137/840 X |

*Primary Examiner*—Harold W. Weakley

*Attorney, Agent, or Firm*—Nathan Edelberg; Robert P. Gibson; Saul Elbaum

[57] ABSTRACT

A fluidic pyrotechnic initiator capable of initiating a fluid resonator cartridge initiator upon receipt of a low pressure input signal. A monostable supersonic wall-attachment fluidic amplifier is used with a control channel to detach the supersonic jet, causing it to impact the resonator tube of the initiator. A vent is provided to keep an over pressure in the control channel from initiating the cartridge.

8 Claims, 1 Drawing Figure

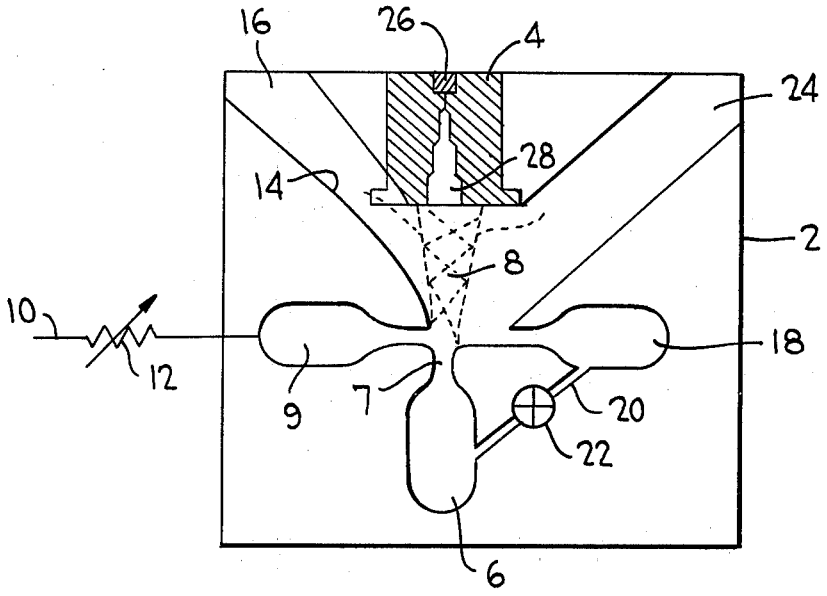
16
26
4
24
28
14
2
8
10
18
12
9
7
20
22
6

FLUIDIC LOGICAL PYROTECHNIC INITIATOR

RIGHTS OF THE GOVERNMENT

The invention described herein may be manufactured, used, and licensed by or for the United States Government for governmental purposes without the payment to us of any royalty thereon.

BACKGROUND OF THE INVENTION

This invention relates generally to relay devices, and more particularly to a fluidic relay device using a supersonic fluid amplifier in combination with means for generating thermal energy.

U.S. Pat. No. 3,578,011 to Holmes, patented May 11, 1971, discloses a pyro fluidic relay device using a supersonic fluid amplifier to activate a resonator tube and generate thermal energy when a control pressure switches the amplifier to an active mode of operation. A potential safety problem exists with such a device since a high pressure pulse at the control port, such as one caused by high pressure gas used to purge or clean the controller circuit, could activate the resonator tube.

SUMMARY OF THE INVENTION

It is, therefore, an object of the instant invention to provide a fluidic relay device which will not be activated by an overpressure in the control channel.

It is a further object of the invention to provide a safe means for logically initiating a fluidic cartridge initiator.

Still another object of the subject invention is to provide a fluidic relay device having a structure capable of compactly housing a fluidic cartridge initiator.

Briefly, in accordance with this invention, the foregoing and other objects are attained by providing a monostable supersonic wall-attachment fluid amplifier with a structure to house a fluidic cartridge initiator between the attachment wall and a vent. The amplifier is provided with adjustments to allow centering of the supersonic jet on the initiator by a control signal of known strength.

Additional objects, features, and advantages of the instant invention will become apparent to those skilled in the art from the following detailed description and attached drawings on which, by way of example, only the preferred embodiment of the instant invention is illustrated.

BRIEF DESCRIPTION OF THE DRAWINGS

FIG. 1 is a cross-section of a fluidic pyrotechnic initiator according to the present invention.

DESCRIPTION OF THE PREFERRED EMBODIMENT

Referring to FIG. 1 there is shown a monostable supersonic wall-attachment amplifier 2 housing fluidic cartridge initiator 4. Amplifier 2 has a supply port 6 with a converging diverging nozzle 7 to produce a supersonic shock pattern when jet 8 is flowing straight. Jet 8 will normally be attached to surface 14 and discharge through vent 16 in the absence of any control signal at control port 9. Bias port 18, supplied from supply port 6 by line 20, serves to assure that jet 8 will attach to surface 14 in the absence of a control signal at control port 9. Bias valve 22 permits adjustment of the bias to assure attachment and allow the jet 8 to detach from surface 14 at a desired control pressure. Valve 12 allows adjustment of the control pressure arriving in line 10 so that the control signal will center jet 8 on resonance tube 28 of initiator 4 when the control signal is received. The resonance tube 28 will then generate heat in a well known manner to ignite pyrotechnic 26. Should high pressure surge, such as that caused by the use of high pressure gas to purge or clean the controller circuit, appear as the control signal at 9, the flow would discharge through vent 24, thus avoiding accidental firing of initiator 4.

Amplifier 2 is formed by milling out the passages in two halves, split along the mid-plane. Fluidic initiator 4, which is axisymmetric except for a slot cut for vent 16, is inserted in a reamed out hole on the centerline before the two halves are screwed together. It is noted that the initiator 4 could be made conical in shape to avoid the necessity of cutting a slot for the vent 16.

Though the invention has been illustrated as having a pyrotechnic output, other output means are conceivable. For example the amplifier 4 could be used to power a thermoelectric generator like that taught in U.S. Pat. No. 3,839,094 or to activate a battery as taught in U.S. Pat. No. 3,863,571.

We wish it to be understood that we do not desire to be limited to the exact details of construction shown and described, for obvious modifications can be made by a person skilled in the art.

We claim:

1. A fluidic relay device comprising:

output means for generating an output when impacted by a supersonic jet; and a monostable fluid amplifier comprising a power nozzle for emitting a supersonic fluid jet, a first vent means having a flow attachment surface to which said supersonic jet attaches when said amplifier is in its stable mode, a control channel for emitting a control fluid to direct said supersonic jet to impact said output means, and a second vent means for venting said fluid jet away from said output means when the pressure of said control fluid exceeds a desired level.

2. The fluidic relay of claim 1 wherein said amplifier further includes a bias port for continuously emitting fluid to bias said supersonic jet toward said attachment surface.

3. The fluidic relay of claim 2 wherein said bias port and said power nozzle have a common fluid supply source.

4. The fluidic relay of claim 3 wherein said bias port is supplied by said common source through a line having a valve for adjusting the bias.

5. The fluidic relay of claim 1 wherein said output means is located between said attachment wall and said second vent means.

6. The fluidic relay of claim 5 wherein said output means is supported by said fluid amplifier.

7. The fluidic relay of claim 5 wherein said output means comprises a fluid resonator tube.

8. The fluidic relay of claim 7 wherein said resonator tube is axially aligned with said power nozzle.

* * * * *